US005956873A

United States Patent [19]

Hess

[11] Patent Number: 5,956,873

[45] Date of Patent: Sep. 28, 1999

[54] ROOF PLOW

[76] Inventor: Richard W. Hess, R.D. #9, Box 82, Bloomsburg, Pa. 17815

[21] Appl. No.: 08/954,107

[22] Filed: Oct. 20, 1997

[51] Int. Cl.[6] ..... E01H 5/02; A01B 1/02

[52] U.S. Cl. ..... 37/265; 37/284; 37/285; 294/54.5; 294/55

[58] Field of Search ..... 37/265, 284, 285; 294/54.5, 55, 57, 58

[56] References Cited

U.S. PATENT DOCUMENTS

| | | | |
|---|---|---|---|
| 173,964 | 2/1876 | Jones | 294/54.5 |
| D. 190,820 | 7/1961 | O'Connor | 37/284 |
| 2,896,993 | 7/1959 | Pollock | 37/284 |
| 4,153,287 | 5/1979 | Townsend | 294/51 |
| 4,199,181 | 4/1980 | Mason | 294/54 |
| 4,538,847 | 9/1985 | Lapshansky | 294/51 |
| 4,559,726 | 12/1985 | Moisan | 37/267 |
| 4,865,373 | 9/1989 | Hudson | 294/54.5 |
| 5,067,197 | 11/1991 | Cormier | 15/244.1 |
| 5,676,413 | 10/1997 | Hauck | 294/54.5 |

OTHER PUBLICATIONS

Quickie Double Bubble, "Easier Does It," The Washington Post, Feb. 1, 1996.

*Primary Examiner*—James A. Lisehora
*Assistant Examiner*—Gary S. Hartmann

[57] ABSTRACT

The invention is a hand operated snow removal device adjustable for use on both pitched or flat surfaces. It consists of a scooping element supported on an adjustable guide spacer attached to the scooping element adapted to support the scooping element above the snow surface. A handle extends through the scooping element and is adjustably clamped for a flat roof use or a pitched roof use. It is hand operated by a forward and backward motion of the handle which picks up and discharges snow to the side as it is being operated.

1 Claim, 3 Drawing Sheets

Fig. 4.
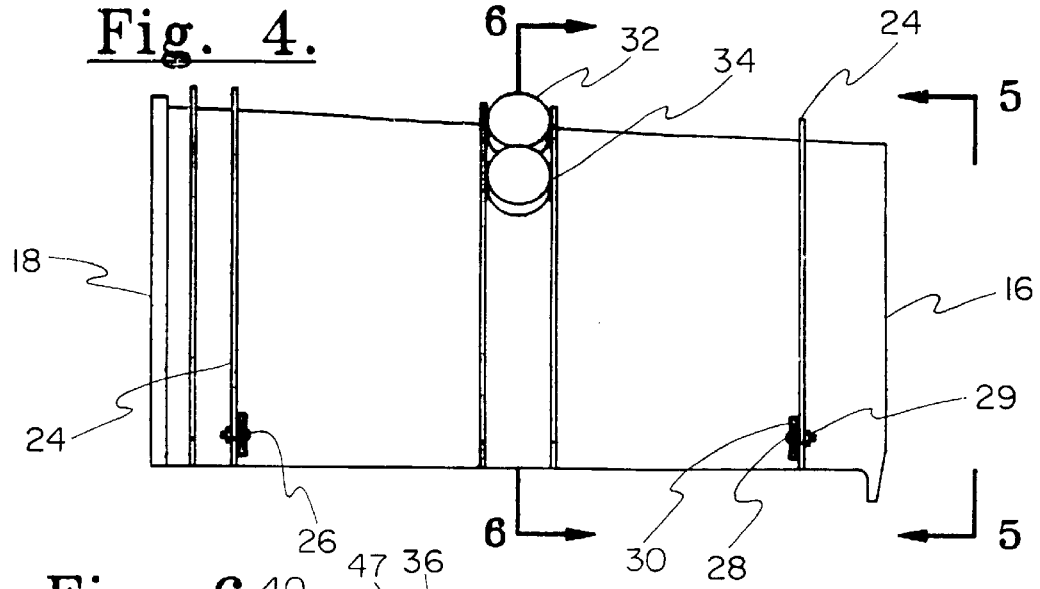
Fig. 6.
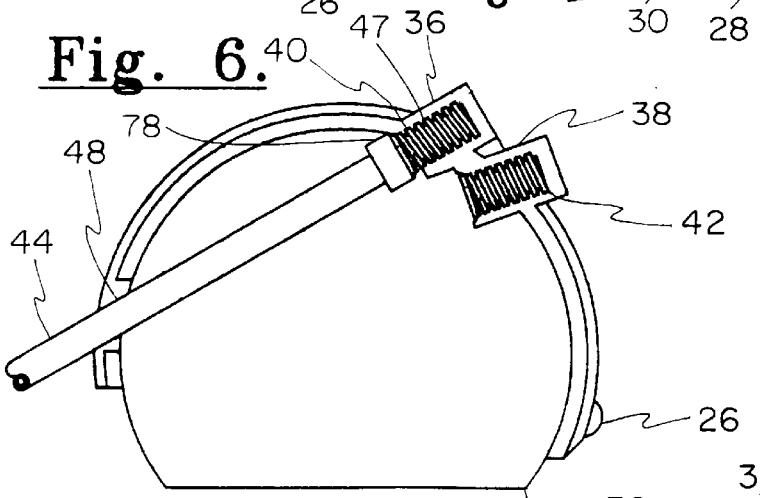
Fig. 5.
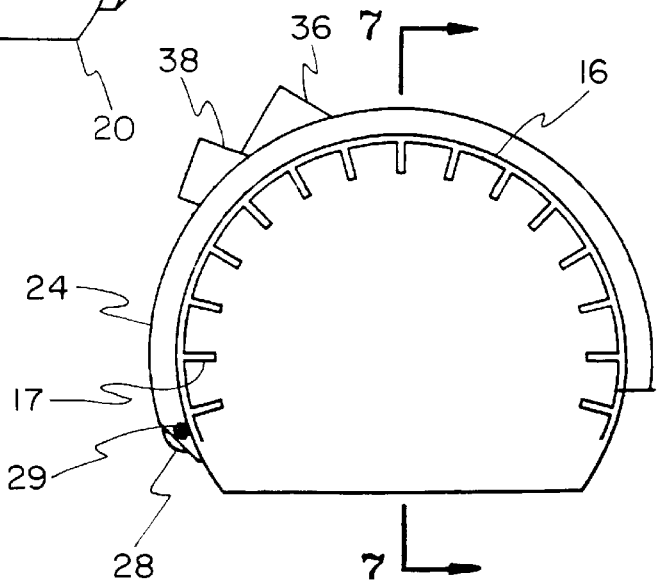
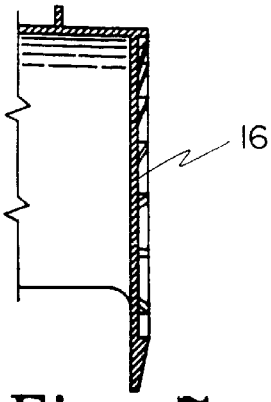
Fig. 7.

ROOF PLOW

BACKGROUND OF THE INVENTION

FIELD OF THE INVENTION

This invention relates to snow removal devices and in particular to hand-operated self-loading adjustable snow removal devices for use on a pitched roof or on a flat surface.

The hand removal of snow from roof or walk can be a strenuous operation requiring the lifting of snow as with a snow shovel or exhausting forward or backward movement as with a snow plow. With this device persons with back problems often are able to perform the necessary task to remove snow from a pitched roof by standing on the ground, not the roof.

SUMMARY OF THE INVENTION

The Roof Plow is designed to remove snow from roofs, walks and driveways. When doing roofs, most snow can be removed from one story buildings with the user standing on the ground. The user may never have to go on the roof to use this device. Simply by placing the Roof Plow on the lower edge of the roof near the gutter, the user can remove the snow. Because of the shape of the Plow, it is not necessary to lift it again while doing the entire side of the roof. Just push the device, which is fastened to a long handle (telescopic is most convenient). It slides over the snow regardless of how deep the snow is. When the user pulls the snow removing device toward himself it digs in, removing the snow. The device is curved in a ⅔ circle shape allowing it to glide easily over the snow at any depth. Just push and pull. These-are the only two motions necessary to remove the snow on the entire side of the roof. The further up you wish to remove the snow, the longer you need to extend the handle. The device does not need to be taken off the roof to extend the handle. Because of the curve in the Roof Plow, the snow being removed is forced into a rolling motion and comes easily down the roof and over the edge without the device coming off. The Roof Plow has guides that suspend the cutting edge of the Plow slightly above the roof. This prevents the device from scraping over the shingles, which over time could cause early wear on the roof and device.

This snow removing device is made from plastic and is adjustable so it can be used on the ground or roof. The upper hollow cylinder is for pitched roofs while the lower hollow cylinder is for removing snow from flat roofs, (using a ladder), driveways and walks, or other flat surfaces where the snow is to be removed. On the rear side of the device is an elongated hole. The handle passes through this hole and is fastened in a hollow cylinder on the back side of the device where there are two adjustment hollow cylinders to select from.

The elongated hole serves two purposes. It allows the handle to pass through it easily so it can be fastened in a hollow cylinder on the back side of the device. It also allows the device to flex, if during use it catches on objects such as ice on shingles, uneven sidewalks or driveways that are not paved. By flexing, the roof or the device is less likely to be damaged and it is easier on the person using the Roof Plow because the device does not catch on the solid objects. When the device flexes, it allows the Roof Plow to skip over the object it comes in contact with.

Using the Roof Plow for removing snow from walks and driveways is quite easy since there is very little lifting and no bending. It is similar to removing snow from the roof except the user is reaching down and outward instead of up.

Only use of a short length of handle, 6' to 8', is sufficient. Push the device over the accumulated snow to get the desired length of the swath to be removed, then pull toward yourself; the snow is removed. As you pull the device toward yourself, the snow is rolled in your direction and easily comes out of the device as it is slightly lifted at the end of the swath taken.

When doing driveways, pull half of the snow to one side of the driveway, going the full length of the driveway, then go to the opposite side and repeat the same motion. Reach out and over the accumulated snow to where the snow has been previously removed and pull toward yourself. Example: By removing 5' or 6' of snow from one side of the driveway and then going to the other side and removing 5' or 6' of snow, an opening of 10' to 12' wide can be obtained.

This device can be used for moving grain such as wheat, oats or shelled corn. Example: Pull grain from back end of wagon or truck using same method as for removal of snow. Just push and pull. User of the device would stand on the ground or barn floor.

The device can be used for cleaning snow from steps by setting device on the open end and pulling it across the steps.

The Roof Plow can be used diagonally to remove snow from roofs. This method would be necessary when buildings are too close together to use the device up and down the roof. Example: The handle of the device could come in contact with the building adjacent to the building the snow is being removed from.

OBJECTS OF THE INVENTION

An object of this invention is to provide a snow removal device which is adjustable to operate on a pitched roof or on a flat surface.

Another object of this invention is to provide a snow removal device which operates with a push-pull movement.

Still another object of this invention is to provide a snow removal device which need not be lifted to operate.

Yet another object of this invention is to provide a snow removal device operable in any depth of snow.

Still another object of this invention is to provide a snow removal device in which the snow is discharged in a pre-determined area.

Another object of this invention is to provide a device for moving grain-like substances, (such as wheat, oats and shelled corn), about.

BRIEF DESCRIPTION OF THE DRAWINGS

FIG. 4 is a front perspective view of the invention without the handle element.

FIG. 5 is a view partially in section along lines 5—5 of FIG. 4.

FIG. 6 is a view partially in section taken along lines 6—6 of FIG. 5.

FIG. 7 is a view taken along lines 7—7 of FIG. 5.

DETAILED DESCRIPTION OF THE PREFERRED EMBODIMENTS

Figure 1:
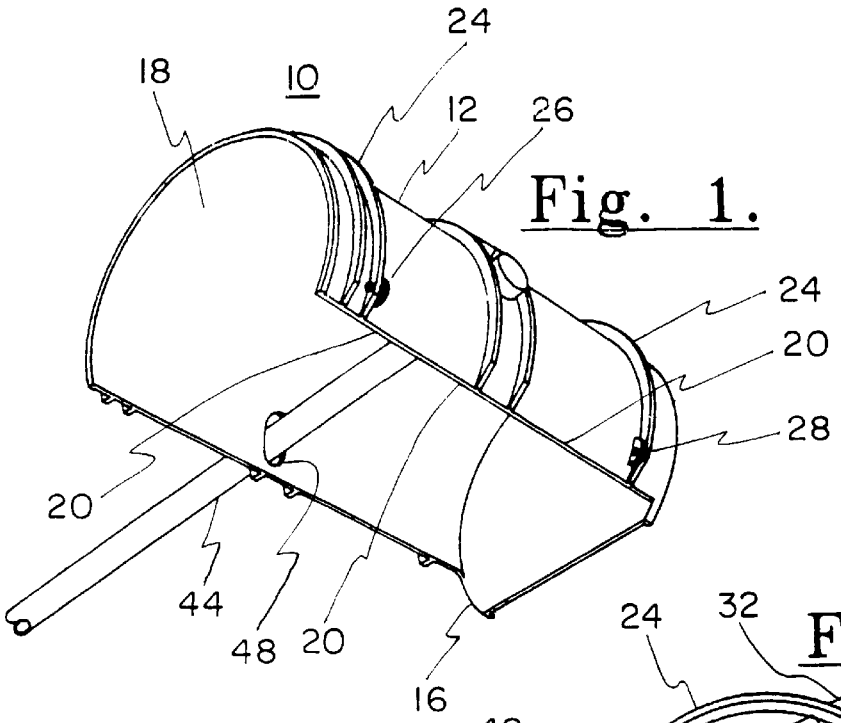
FIG. 1 is a perspective view of the Plow according to this invention with the handle in position.

Referring now to the drawing, and in particular, FIG. 1, 10 represents the invention having a scoop 12 connected to attached handle 44. Scoop 12 is generally of the shape of a frustum of a cone with a closed end portion 16 and a larger open end portion 18. Scoop 12 is generally positioned perpendicular to attached handle 44 and has a closed end portion 16 on one end thereof and an open end portion 18 on the other end thereof. A scraping surface 20 extends from the closed end portion 16 to the open end portion 18, and in operation is in contact with the snow surface 22 to be plowed. Ribs 24 extend peripherally around scoop 12 in the same direction of movement of scoop 12. Ribs 24 act to guide scoop 12 in a straight line during the plowing operation. A right guide 26 is positioned on a rib 24 on open-end portion 18 of the scoop 12. A left guide 28 is positioned on a rib 24 on closed end portion 16 of the scoop 12. Right guide 26 and left guide 28 extend outwardly from scoop 12 and hold the scraping surface 20 away from the snow surface 22 to be plowed. In this way, the scraping surface 20 will not contact the snow surface 22 and be needlessly worn. Left guide 28 and right guide 26 are comprised of semi-circular element 30 which is bolted to ribs 24 and extends outwardly from scoop 12. Thus the right guide 26 and left guide 28 will bear the abrasion leaving the scraping surface 20 relatively unabraised. In addition, right guide 26 and left guide 28 will elevate the scraping surface 20 above the snow surface 22 so that protrusions, rocks, nails or other uneven surfaces will not impede the movement of the scoop 12.

Figure 2:
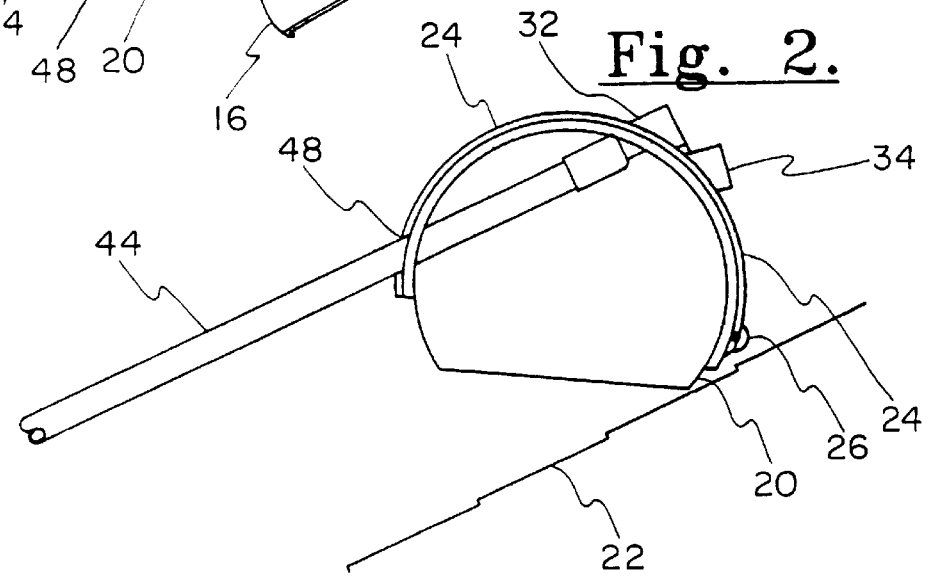
FIG. 2 is a right side view of this invention in use on a slanting shingled roof showing the guides not in contact with the slanting surface.
Figure 3:
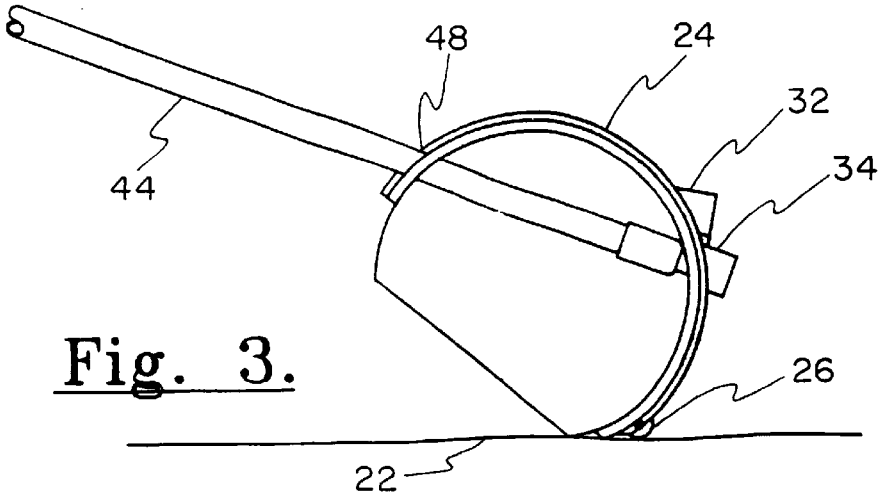
FIG. 3 is a right side view of this invention in use on a flat surface showing the guides in contact with the flat surface.

The forward surface of the scoop 12 has a pitched roof element 32 on the upper portion thereof and a flat roof element 34 on a lower portion of the scoop 12. Both the pitched roof element 32 and the flat roof element 34 are comprised of internally threaded hollow cylinders 36 and 38 with internal threads 40 and 42 therein. Both the internally threaded hollow cylinder 36 and internally threaded hollow cylinder 38 are cast into the surface of scoop 12. Handle 44 extends into the interior of scoop 12 through an oval hole 48 in the rear portion of scoop 12. Handle 44 fits loosely in oval hole 48 and may be moved freely therein for greatest flexibility. Handle 44 is comprised of a handle 44 and a threaded end portion 47 and may be telescopic. The threaded end portion 47 will mate with internal threads 40 or 42 of internally threaded hollow cylinder 36 and internally threaded hollow cylinder 38. If the Plow/invention 10 is to be used on a pitched roof or a sloping one, the handle 44 is screwed into the pitched roof element 32. If the Plow/invention 10 is to be used on a flat roof or sidewalk the handle 44 is screwed into the flat roof element 34. FIG. 2 illustrates the use of the Plow/invention 10 on a pitched roof whereas FIG. 3 illustrates the use of the Plow/invention 10 on a flat roof or sidewalk. The angle of the scraping surface 20 with the snow surface 22 best use has been determined empirically by using the device. The user can elevate or depress the handle 44 so as to vary the angle of attack of the scraping surface 20 to suit the snow condition. The angle that scraping surface 20 makes with the snow surface 22 may be controlled by raising or lowering handle 44. It was empirically found that the pitched roof element 32 should be above the flat roof element 34.

In operation the user determines if the Plow/invention 10 is to be used on a pitched roof and if so, screws the handle 44 into pitched roof element 32. The Plow/invention 10 is then placed on the snow surface 22 and moved forward and backward thus allowing the scraping element 20 to scrape snow from the snow surface 22 into the interior of the scoop 12. When sufficient snow has filled the interior of the scoop 12, it is discharged through the open end portion 18 of the scoop 12. Only a forward and backward motion is necessary to allow the Plow/invention 10 to operate efficiently. It is not necessary to pick the Plow/invention 10 up during the operation. When it is desired to plow a flat roof 34 the handle 44 is placed in the flat roof element 34 and plowing proceeds in the previously described manner. Oval opening 48, through which handle 44 is placed, allows the scoop 12 to be flexible, to move in many directions to avoid being caught on roof nails, obstructions or other objects on the snow surface 22. When used on a pitched roof, the Plow/invention 10 is generally moved upward and downward with the pitch of the roof. However, it can also be used diagonally to remove snow from roofs. This might be necessary when buildings are too close together to use the device in an up and down motion.

It should be noted that the angle that the scraping surface 20 makes with the snow surface 22 may be changed by raising or depressing the handle 44. The optimum angle may be determined by the user in his scraping operation. Angles between 30 to 50 degrees have been found to be most efficient. The scraping operation is initiated by grasping the handle 44 and forcing the scoop 12 in a forward and backward motion. With this motion the scoop 12 fills with snow and eventually ejects it through the open end portion 18 of the scoop 12. Hence the snow may be deposited in a pre-determined area by manipulating the path that the scoop 12 proceeds over the snow surface 22.

It should be noted that pitched roof element 32 is positioned above flat roof element 34 to allow the angle of handle 44 to be more easily manipulated by the operator of the Plow/invention 10. Alternatively handle 44 may be secured to Plow/invention 10 by a nut 82 engaging the end threaded portion 47 of handle 44. Furthermore right guide 26 and left guide 28 may be replaced by wheels rotatably bolted to ribs 24. Handle 44 may be telescopic and of adjustable length.

The Plow/invention 10 may be made of plastic or other material that will flex with and during use. It however may be made of sheet metal and other materials as well. It should be noted that left guide 28 and right guide 26 are bolted to ribs 24 on the left and right ends of scoop 12.

The distance of the right guide 26 and left guide 28 from the scraping surface 20 can be increased by using larger sized guides 26 and 28. By so doing the guides 26 and 28 would be closer to the scraping surface 20 thus making a greater distance between the scraping surface 20 and the snow surface 22 to be removed. This setting could be used for clearing snow from roofs made of metal with nail heads sitting on top of the roofing seams. If the scraping surface 20 of the snow removal device was not raised, the scraping surface 20 of the device could catch on the nail heads.

The guides 26 and 28 on the device may be removed completely. Then the scraping surface 20 would scrape over the sidewalk or driveway like the edge of a snow shovel to remove all of the snow.

Figure 8:
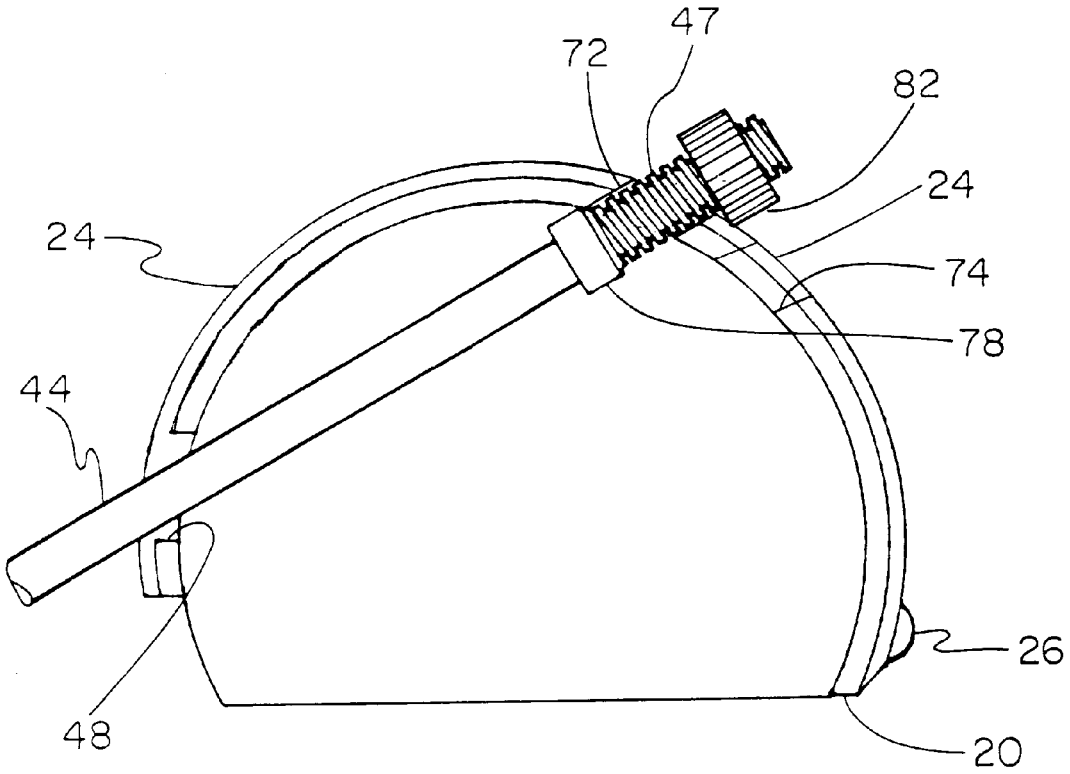
FIG. 8 is an enlarged right side view of a modification of the invention in which the screw-threaded handle is secured to the scoop by a threaded nut. It represents a medium section view through scoop 12 and is similar to the section set forth in FIG. 6.

A modification of this invention may be seen in FIG. 8 in which pitched roof element 32 is replaced by pitched roof hole 72 extending through scoop 12. Flat roof element 34 is replaced by flat roof hole 74 extending through scoop 12. Handle 44 with threaded end portion 47 extends through oval hole 48 and through either pitched roof hole 72 or flat roof hole 74 depending on the slope of the snow surface 22 to be cleared. A nut 82 is screwed on threaded end portion 47 to handle 44.

A collar 78 is positioned about threaded end portion 47 and bears against scoop 12 when nut 82 is tightened clamping handle 44 securely to scoop 12.

FIG. 2 of the drawings show the scraping surface 20 making contact with the snow surface 22. Handle 44 may be raised or lowered so that right guide 26 and left guide 28 elevates the scraping surface 20 above the snow surface 22. The scraping surface 20 is thus not eroded by scraping contact.

The left guide 28 and right guide 26 are made of a semicircular element 30 which is attached to the ribs 24 by a bolt and nut 29. This bolt 29 extends through the semicircular element 30 and the rib 24. The nut 29 is screw-connected to the bolt 29 and tightens semicircular element 30 on to rib 24.

I claim:

1. A roof plow comprising a scooping element having an open end portion on one end and a closed end portion on an opposite end thereof, the closed end portion being smaller than the open end portion;

a scraping element extending between said open end portion and said closed end portion;

a handle extending through a handle hole in said scooping element;

a first handle securing means attached to said scooping element; wherein the scraping element makes a first angle relative to a snow surface when said handle is attached to said first handle securing means;

a second handle securing means attached to said scooping element; wherein the scraping element makes a second angle relative to said snow surface when said handle is attached to said second handle securing means; said first angle being different from said second angle;

a guide spacer attached to a lower outside portion of said scooping element, said guide spacer in contact with said snow surface;

ribs extending outwardly from said scooping element and in contact with said snow surface;

wherein said guide spacer consists of two guides positioned proximate to said end portions of said scooping element and in contact with said snow surface;

and wherein said guides consist of curved elements removably attached to said ribs and extending outwardly therefrom.

* * * * *